US006866069B2

(12) United States Patent
Moeneclaey et al.

(10) Patent No.: US 6,866,069 B2
(45) Date of Patent: Mar. 15, 2005

(54) RAPIER FOR A RAPIER LOOM

(75) Inventors: Denis Moeneclaey, Oostnieuwkerke-Staden (BE); Patrick Strubbe, Gistel (BE)

(73) Assignee: Picanol N.V., Ieper (BE)

( * ) Notice: Subject to any disclaimer, the term of this patent is extended or adjusted under 35 U.S.C. 154(b) by 0 days.

(21) Appl. No.: 10/471,293

(22) PCT Filed: Mar. 6, 2002

(86) PCT No.: PCT/EP02/02411

§ 371 (c)(1),
(2), (4) Date: Sep. 22, 2003

(87) PCT Pub. No.: WO02/077343

PCT Pub. Date: Oct. 3, 2002

(65) Prior Publication Data

US 2004/0173278 A1 Sep. 9, 2004

(30) Foreign Application Priority Data

Mar. 21, 2001 (DE) ..... 101 14 755

(51) Int. Cl.[7] ..... D03D 47/20
(52) U.S. Cl. ..... 139/448

(58) Field of Search ..... 139/448, 447, 139/170.3

(56) References Cited

U.S. PATENT DOCUMENTS 3,532,136 A * 10/1970 Balaquer ..... 139/448
3,662,785 A * 5/1972 Kokkinis ..... 139/448
3,986,532 A * 10/1976 Volpe ..... 139/448
4,708,174 A * 11/1987 Vandeweghe et al. ..... 139/448
6,102,084 A * 8/2000 Ruegg ..... 139/448

FOREIGN PATENT DOCUMENTS

AT 000377540 B * 3/1985 ..... 139/448

* cited by examiner

*Primary Examiner*—Danny Worrell
(74) *Attorney, Agent, or Firm*—Bacon & Thomas, PLLC

(57) ABSTRACT

The invention relates to a receiving gripper for a rapier weaving machine, the gripper being fitted at one end with a clamping hook (12) including a clamping surface, the hook being paired with a mating clamp face of a head (15) of a pivotably supported, two-arm lever (14), wherein both the end face of the head (15) and the clamping hook (12) are fitted with guide elements (18, 19) guiding the lever head in the circumferential direction relative to a pivot pin for the lever.

11 Claims, 3 Drawing Sheets

RAPIER FOR A RAPIER LOOM

BACKGROUND OF THE INVENTION

A. Field of the Invention

The present invention relates to a receiving gripper for a rapier loom which is fitted at its front end with a clamping hook including a clamping surface which is paired with a mating clamp face of the head of a two-arm lever pivotally attached about a pivot pin.

B. Related Art

Such a receiving gripper is known for instance from U.S. Pat. No. 3,986,532. A two-arm lever is mounted within a longitudinal slot of a component which is fitted with the clamping hook. The clamping hook comprises a cross-sectionally contoured clamping surface which is paired with a matched, cross-sectionally contoured, mating face of the head of the lever.

Receiving grippers are conventionally used which are fitted, not with a pivotable, two-arm lever, but with a pin displaceable along the longitudinal gripper direction relative to the clamping hook. Such receiving grippers illustratively are known from U.S. Pat. Nos. 4,736,777 and 4,739,805. The pins are retained by a swivel device on a drive lever and are guided by their heads on the hook.

BRIEF SUMMARY OF THE INVENTION

The objective of the present invention is simplification of the design of such a receiving gripper and improving its operation.

This problem is solved by fitting the distal end face of the lever head and the clamping hook with mutually engaging guide elements guiding the lever head in a circumferential direction relative to the pivot pin of the lever.

As a result, a very simple and compact design is attained whereby a small pivoting motion suffices to move the clamping surface of the hook and the mating clamp face of the head comparatively widely and/or rapidly apart to release a thread. The guide elements between the distal end face of the head and the clamping hook preclude relative motions in the axial direction of the pivot pin resulting from oscillations or vibrations between the head and the clamping hook, whereby the thread might be loosened and/or the lever or the clamping hook might be damaged.

In one embodiment of the present invention, the guide elements constitute a geometrically interlocking guide transverse to the direction of motion of the lever's head. In such a geometrically interlocking guide, no elastic biasing elements are needed to preclude relative motions.

In a further embodiment of the present invention, the cross-sectional contours of the hook and/or the head extend also as far as into the clamping surface and/or the mating clamp face. These cross-sectional contours extending the contours guiding the head's distal end face may be made in a simple manner because they can be made using the same tools. The cross-sectional contours in the region of the clamping surface and/or the mating clamp face assure that a thread will be reliably clamped even when relatively small clamping forces are used.

In yet another embodiment of the present invention, the guide elements of the hook and those of the head are recessed relative to the outside contour of the hook. This feature assures that the guide elements will not touch warps during weaving, since the warps otherwise might snag and/or be damaged.

Further features and advantages of the present invention are described in the following description of the embodiments shown in the drawings.

DETAILED DESCRIPTION OF A PREFERRED EMBODIMENT OF THE INVENTION

Figure 1:
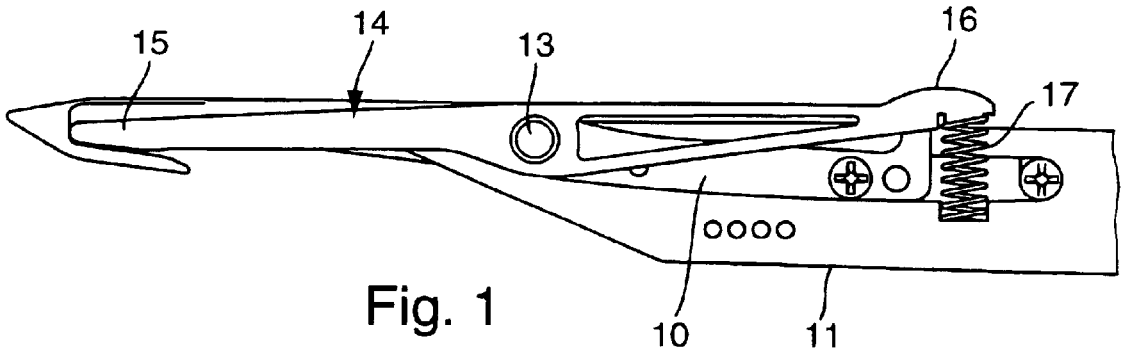
FIG. 1 is a partial elevation view of a receiving gripper of the invention.
Figure 2:
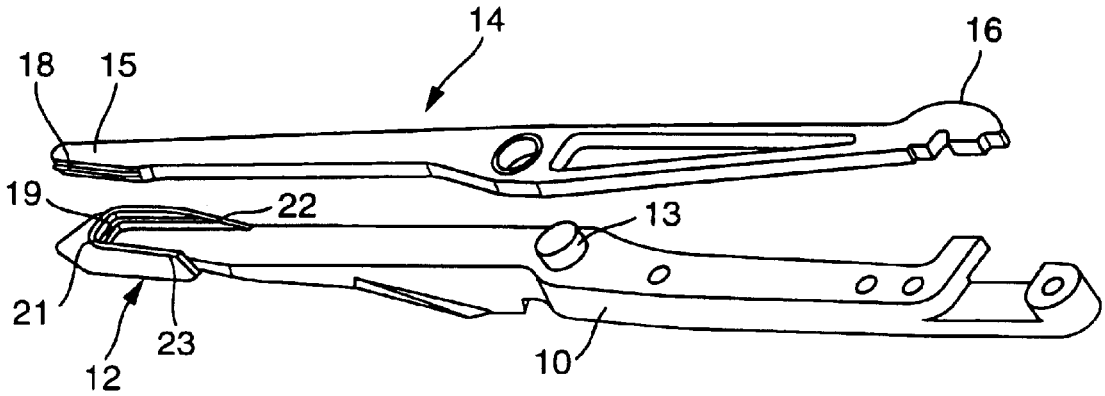
FIG. 2 is an exploded view of selected parts of the receiving gripper of FIG. 1.
Figure 3:
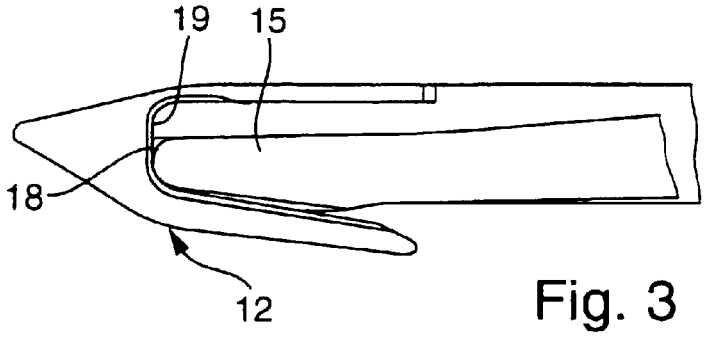
FIG. 3 is an enlarged top view of the region of the clamping hook of the receiving gripper in its closed position.
Figure 4:
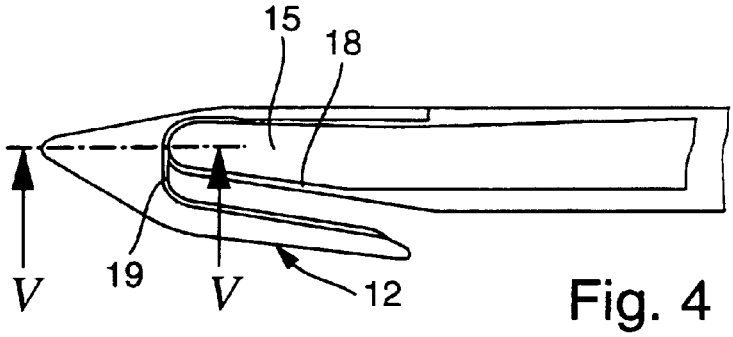
FIG. 4 is a view corresponding with FIG. 3, with the hook in the open position.

The receiving gripper shown in FIG. 2 comprises a component or base part 10 affixed to a guide element 11 which extends into an unshown gripper tape. The component 10 is made of metal, plastic or ceramic material and is filled at its front end with a clamping hook 12. A transversely extending pivot or axle pin 13 projects from the component 10 perpendicularly to the guide element 11, which in this instance is made of plastic material, and hence perpendicularly to the gripper tape, and serves as a pivot pin for a two-arm lever 14 also made of metal, plastic or ceramic material. The end of one of the arms of the two-arm lever 14 is configured as a head 15 constituting a mating clamp face cooperating with a clamping surface of a clamping hook 12. The end of the other arm of the lever 14 is configured as a drive element 16 projecting laterally from the gripper and is associated with a stop by means of which the lever 14 may be opened upon running against said stop. Within the range of the drive element, the lever 14 is loaded by a pre-stressed spring, for instance a compression spring 17, which assures that the mating clamp face of the head 15 of the lever 14 rests with a predetermined force against the clamping surface of the clamping hook 12.

An unshown small cover acts as a rest for the compression spring 17, shielding its location and is affixed to the component 10. This small cover also acts as a connection element connecting the guide element 11 with the unshown gripper tape. The cover element is made of metal or plastic and is fitted with guide strips or guide edges which prevent contact between the gripper tape and/or the guide element 11 on one hand with warps on the other hand.

The distal end face of the lever's head 15 is fitted with guide elements 18 in the form of several ribs with troughs in-between (FIG. 5) which engage geometrically matching guide elements 19 of the clamping hook 12. The guide elements 18, 19 extend transversely relative to the pivot pin 13 of the lever 14, and as a result said elements guide the lever 14 circumferentially about the pivot pin. Extending transversely to the direction of motion of the lever head 15, these guide elements 18, 19 constitute a geometrically interlocking guide, and as a result oscillations or vibrations cannot cause the lever head 15 to move axially relative to the pivot pin.

In the form of V-shaped ribs and troughs, the guide elements 18, 19 in this particular embodiment also extend as far as into the clamping surface of the clamping hook 12 as well as into the mating clamp face of the head 15. These cross-sectional contours may be easily made in continuous contours using a milling tool and/or grinding devices. As shown in particular in FIG. 2, the guide elements 19 furthermore have been processed into the region opposite the clamping surface of the clamping hook 12, where they terminate.

In this embodiment, the guide elements 18, 19 each are constituted of substantially matching troughs and ribs. Modifications of this geometry may easily be carried out, in particular the number of ribs and troughs may be enlarged or made smaller. Nor need the ribs and troughs be all the same. Furthermore the cross-sectional contours situated in the region of the clamping surface of the clamping hook 12 and of the mating clamp face of the head 15 may differ from the guide elements running from the end zone of the head 15.

For example, the troughs can be deeper and/or the ribs can be shorter within the region of the clamping surface and the mating clamp face.

The ribs and troughs constituting the guide elements 19 of the clamping hook 12 extend tangentially to or concentrically with the pivot defined by the pin 13 within that region which is associated with the end face of the head 15 of the lever 14.

Figure 6:
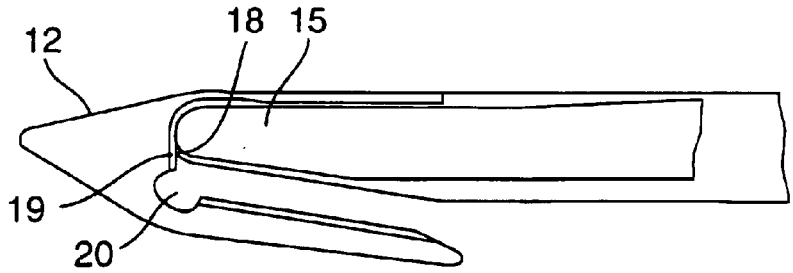
FIG. 6 is a view similar to that of FIG. 4 of a different embodiment.

A recess 20 is present in the clamping hook in the embodiment of FIG. 6 between, on one hand, the cross-sectional contours 19 constituted of ribs and troughs associated with the cross-sectional contours 18 of the end face of the head 15 of the lever 14, and, on the other hand, the extensions inserted into the clamping surface. As a result, an inserted thread may be guided in said recess 20 without being required to move along the cross-sectional contours constituting the guide elements 19.

FIG. 2 shows that the component 10 comprises a substantially planar top side and that the lever 14 runs parallel to said side. Within the region of the clamping hook 12, an insert 21 projects from a planar surface of the component 10 and terminates by means of guide edges 22, 23 at surfaces of the component 10. The insert 21 is fitted with the guide elements 19 in the head 15 of the lever 14. The front end of the clamping hook is a tip and is situated at approximately the level of the underside of the component 10. The tip flares into a wedge-geometry toward the said insert.

Figure 5:
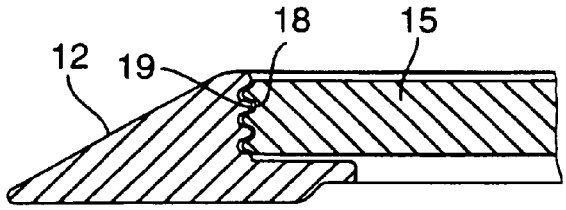
FIG. 5 is a section view along line V—V of FIG. 4.
Figure 7:
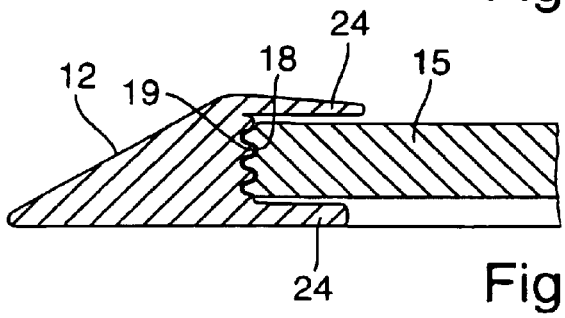
FIG. 7 is a view similar to that of FIG. 5 of another embodiment.

FIG. 7 shows an embodiment similar to that of FIG. 5, where now the front end of the head 15 of the lever 14 is covered at the top and bottom by shields 24 of the hook-part of the base unit 10. These shields 24 on both sides of the head 15 are used to reduce the danger that threads should penetrate the region of the clamping hook 12. In a modified embodiment, the clamping surface of the clamping hook 12 and/or the mating clamp face of the head 15 lack cross-sectional troughs or ribs.

Figure 8:
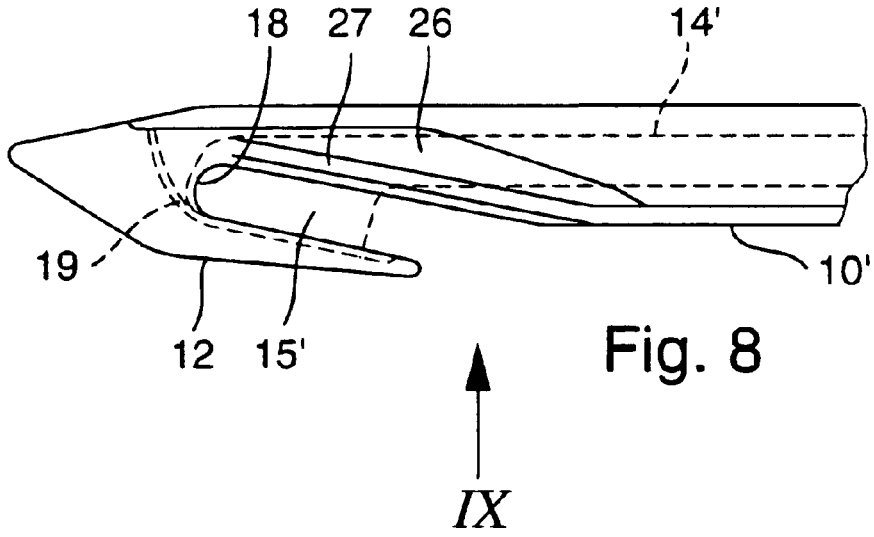
FIG. 8 is a top view of another embodiment.
Figure 9:
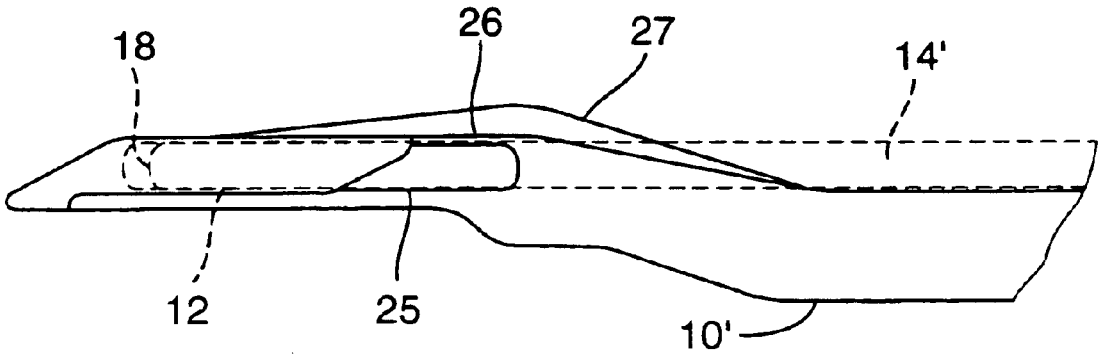
FIG. 9 is a view in the direction of the arrow IX on the embodiment of FIG. 8.

As regards the embodiment of FIGS. 8 and 9, the component 10'—which is coupled to the lever 14—is bent in its end zone in such a manner that the clamping hook 12 and the lever 14' indicated in dashed lines will be located in a common plane. The region of the component 10' which is opposite the clamping hook 12 is fitted with a longitudinal slot 25 allowing passage of the lever 14' with its head 15'. In this manner the component 10' constitutes a bail 26 spanning, at the top, the zone of the head 15' of the lever 14'. A guide rib 27 projects upward from said bail 26 and runs parallel to the clamping hook 12 and hence substantially in the longitudinal direction of the receiving gripper.

The present invention is not restricted to the above shown illustrative embodiments. In particular a guide rib similar to the guide rib 27 may be added in the front zone of the component 10' of the embodiment of FIGS. 8 and 9, where this latter guide rib projects downward from the said component.

What is claimed is:

1. Receiving gripper for a rapier weaving machine, comprising a gripper fitted at its front end with a clamping hook which comprises a clamping surface and which is associated with a mating clamp face of a head of a two-arm lever supported in pivotable manner about a pivot pin, wherein the head includes a distal end face and wherein the distal end face of the head and the clamping hook are fitted with mutually engaging guide elements guiding the head of the lever in the circumferential direction relative to the pivot pin of the lever.

2. Receiving gripper as claimed in claim 1, wherein the guide elements comprise a geometrically interlocking guide extending transversely to the direction of motion of the head of the lever.

3. Receiving gripper as claimed in claim 1, wherein the guide elements of the head of the lever and the guide elements of the clamping hook define mutually engaging cross-sectional contours.

4. Receiving gripper as claimed in claim 1, wherein the guide elements of the clamping hook extend substantially tangentially relative to the pivot pin of the lever.

5. Receiving gripper as claimed in claim 1, wherein the cross-sectional contours of the clamping hook and/or of the head extend also as far into the clamping surface and/or the mating clamp face.

6. Receiving gripper as claimed in claim 1, wherein the guide elements of the clamping hook and the guide elements of the head are offset to the rear of the outer periphery of the clamping hook.

7. Receiving gripper as claimed in claim 6, wherein the lever extends substantially parallel with a component fitted at its end with the clamping hook, said hook comprising an insert that is configured for the head of the lever and that is fitted on its inside with the guide elements.

8. Receiving gripper as claimed in claim 1, wherein the zone of a component opposite the clamping hook comprises a bail spanning the head of the lever at the top side.

9. Receiving gripper as claimed in claim 8, wherein the bail is fitted with an upwardly projecting guide rib substantially extending in the longitudinal direction of the receiving gripper.

10. Receiving gripper for a rapier weaving machine, comprising a gripper fitted at its front end with a clamping hook which comprises a clamping surface and which is associated with a mating clamp face of a head of a two-arm lever supported in pivotable manner about a pivot pin, wherein the head includes a distal end face and wherein the distal end face of the head and the clamping hook are fitted with mutually engaging guide elements guiding the head of the lever in the circumferential direction relative to the pivot pin of the lever and further wherein the guide elements of the clamping hook extend substantially concentrically with the pivot pin of the lever.

11. Receiving gripper for a rapier weaving machine, comprising a gripper fitted at its front end with a clamping hook which comprises a clamping surface and which is associated with a mating clamp face of a head of a two-arm lever supported in pivotable manner about a pivot pin, wherein the head includes a distal end face and wherein the distal end face of the head and the clamping hook are fitted with mutually engaging guide elements guiding the head of the lever in the circumferential direction relative to the pivot pin of the lever and further wherein the clamping hook comprises a recess between the guide elements extending in the clamping surface zone and associated guide elements extending in the distal end face of the head of the lever.

* * * * *